US006702568B1

(12) United States Patent
Park

(10) Patent No.: US 6,702,568 B1
(45) Date of Patent: Mar. 9, 2004

(54) METHOD OF BURNING EMULSION FUEL OIL

(76) Inventor: Kil-Won Park, No.166-92,Sindang 5-dong, Jung-gu, Seoul (KR)

( * ) Notice: Subject to any disclaimer, the term of this patent is extended or adjusted under 35 U.S.C. 154(b) by 0 days.

(21) Appl. No.: 10/302,713

(22) Filed: Nov. 25, 2002

(30) Foreign Application Priority Data

Oct. 14, 2002 (KR) ..... 10-2002-0062475

(51) Int. Cl.[7] ..... F23J 7/00; C10L 1/10
(52) U.S. Cl. ..... 431/4; 431/8; 44/301
(58) Field of Search ..... 431/4, 8, 2; 261/18.2; 44/301; 516/21

(56) References Cited

U.S. PATENT DOCUMENTS 4,144,015 A * 3/1979 Berthiaume ..... 431/8
4,519,769 A * 5/1985 Tanaka ..... 431/4
4,696,638 A * 9/1987 DenHerder ..... 431/4
5,000,757 A * 3/1991 Puttock et al. ..... 44/301
6,066,186 A * 5/2000 Matsumoto ..... 44/301

FOREIGN PATENT DOCUMENTS

EP 0 275 842 A1 * 7/1988 ..... C10L/1/10

* cited by examiner

*Primary Examiner*—Josiah Cocks
(74) *Attorney, Agent, or Firm*—Harrison & Egbert

(57) ABSTRACT

A method of burning emulsion fuel oil, having the advantages of excellent combustion efficiency and fuel saving effect, by selectively burning only a portion having a better emulsification state among the emulsion fuel oil, including a fuel oil additive composition mixed with water using a circulating system. The emulsification state of the fuel oil is maintained at a predetermined level using the circulating system.

2 Claims, 1 Drawing Sheet

METHOD OF BURNING EMULSION FUEL OIL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention pertains to methods of burning emulsion fuel oil. More specifically, the present invention is directed to a burning method of water-in-fuel oil emulsion, which is advantageous in terms of excellent combustion efficiency and fuel saving effect, by selectively burning only a portion having excellent emulsification state and high heat efficiency among emulsion fuel oil comprising a fuel oil additive composition mixed with water, while the emulsification state of the fuel oil is maintained at a desired level, by means of a circulating system including a stirrer and a vertical heating bath connected thereto.

BACKGROUND OF THE INVENTION

With the expectation of future petroleum shortages, there have been proposed various methods for increasing heat efficiency by improvement of boilers or other fuel treating devices, and modification of oil. In addition, there are provided methods for increasing combustion efficiency and decreasing emission of pollutants, in particular, air pollutants, by using combustion enhancers or passing fuel oil through a magnetic field. However, such methods have limited effect on heat efficiency and prevention of air pollution.

Further, modified oil obtained by adding a fuel oil modifying composition consisting mainly of siloxane to fuel oil is increased in combustion efficiency and prevents air pollution, but is low in fuel saving effect.

BRIEF SUMMARY OF THE INVENTION

Therefore, it is an object of the present invention to alleviate problems encountered in the prior art and to provide a method of burning emulsion fuel oil having advantages of excellent combustion efficiency and high fuel saving effect, by stirring the emulsion fuel oil comprising a fuel oil additive composition mixed with a predetermined amount of water by means of a stirrer capable of cutting the fuel oil to fine particles, to obtain emulsion fuel oil having uniformly cut particles, among which emulsion fuel oil having the most preferable emulsification state is selectively burned while the oil emulsification state is continuously maintained at a desired level.

DETAILED DESCRIPTION OF THE INVENTION

Figure 1:
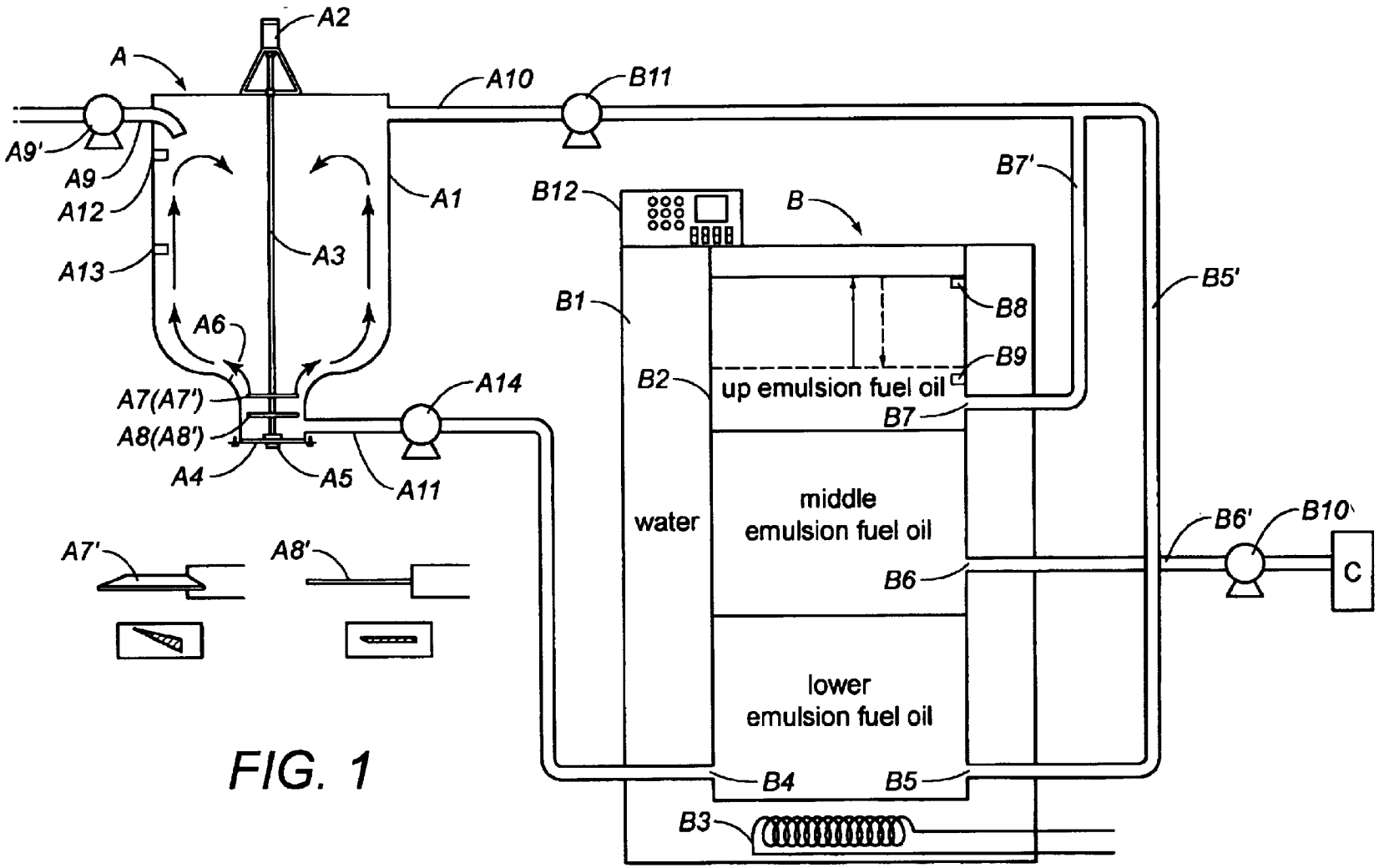
FIG. 1 schematically shows a layout of a circulating system used in a burning method of an emulsion fuel oil according to the present invention.

Based on the present invention, a fuel oil additive composition is mixed with a predetermined amount of water by means of a stirrer, to obtain emulsion fuel oil of excellent emulsification state, among which emulsion fuel oil of better emulsification state is selectively burned while the emulsion fuel oil is continuously maintained at a desired emulsification state by use of a circulating system comprising a vertical heating bath connected to the stirrer. Thus, the present method has the advantages of increased combustion efficiency and fuel saving effect.

As for a preparation of the fuel oil additive composition of the present invention, 300 parts by weight of fine coal powders, 50 parts by weight of a saturated magnesium chloride solution, 100 parts by weight of soda and 500 parts by weight of sea water are mixed together and homogenized, followed by passing the homogenized liquid mixture through a catalyst tower packed with uranium ore maintained at 90–95° C. for 10 minutes.

Then, the liquid mixture passed through the catalyst tower is filled to be half of the coke height in a retort having a packed coke bed, in which bunker C oil is filled in the same amount as the filled liquid mixture according to a volume ratio. The liquid mixture and oil filled in the retort are heated at 95–100° C. until most salt water (85% or more) is evaporated, to obtain a colloidal liquid remainder.

2–4 vol % of the colloidal liquid remainder is added to 96–98 vol % of a mixed oil comprising light oil and bunker C oil at a volume ratio of 1:4 with stirring, thereby preparing the fuel oil additive composition.

As such, salt water (liquid mixture) has a specific gravity of 1 or higher, while bunker C oil has a specific gravity of less than 1. Thus, such water and oil components define boundary therebetween. A heterogeneous two-liquid phase is simultaneously in contact with cokes in the retort, and heated under normal atmosphere.

The colloidal liquid remainder is composed mainly of bunker C oil, water and carbon particles, with a very small amount of an inorganic material contained in tar-salt water. In such colloidal liquid remainder, magnesium chloride and soda are dissolved in water, and water, bunker C oil particles as well as other component particles are tightly adsorbed around fine carbon particles having high adsorptivity. Hence, phase-separation does not occur and the remainder is present in a colloidal state.

As the used carbon materials, black charcoal for a coal lamp may be used, but porous cokes are most preferable in view of large surface area, high strength, low breakage, easy separation from liquid phase after treatment, and easy workability.

Thusly obtained additive composition is mixed with 40–50 wt % of water and stirred by use of a stirrer A shown in FIG. 1, thereby preparing the emulsion fuel oil.

According to the burning method of the emulsion fuel oil having excellent combustion efficiency and fuel saving effect, the fuel oil composition is mixed with 40–50 wt % of water and sufficiently stirred by use of the stirrer A of FIG. 1, to obtain the emulsion fuel oil, which is then burned under the most effective combustion state. For that, while the fuel oil fed into a cylindrical vertical heating bath B is stabilized at 70–80° C. for a long time, emulsion fuel oil obtained from a middle layer of the vertical heating bath is burned.

Referring to FIG. 1, there is shown a circulating system comprising the stirrer A and the vertical heating bath B. In the stirrer A, a rotating shaft A3 which is connected to a motor A2 above a top portion of a funnel-shaped body A1 is connected to a rotating bearing A5 formed at a center portion of a horizontal bottom portion A4 of the body A1, and rotated. On the vertical rotating shaft A3 of a position passing through a small-diameter lower part A6 of the body A1, there is positioned a propeller A7 comprising four slantingly bent blades A7', under which another propeller A8 comprising four blades A8' fixed horizontally to the rotating shaft A3 is disposed. At one side of the upper portion of the body A1, an inlet pipe A9 and a pump A9' for feeding the fuel oil additive composition and water into the stirrer are provided. At the opposite side thereof, an inlet pipe A10 of heterogeneous emulsion fuel oil flowing from a vertical heating bath B is disposed, below which an outlet pipe A11 of the emulsion fuel oil is provided. A pump A14 is mounted to the outlet pipe. Further, a first water surface sensor A12 and a second water surface sensor A13 are attached to inner wall face of the body A1.

In the stirrer, the propeller has very sharp blades and is rotated at 3,600 rpm. The lower part of the body A1 is designed to have a small-diameter, with the aim of fast rotation due to reduced rotation resistance, and of decreasing a motor load. The sharp blade functions to produce many fine particles per unit time at a fast rotation rate.

When the propeller A7 is rotated in the stirrer body A1 together with the rotating shaft A3, the liquid mixture therein is rotated according to arrows represented in the drawing. The lower propeller A8 comprises horizontally very sharp blades A8' with no blade angle, and functions to cut the stirred mixture led towards a center portion A5 of the small-diameter lower part under high pressure while being rapidly rotated. Such a stirrer has various functions of uniformly mixing at least two materials, reducing the homogeneous mixture to a particle size of 2 $\mu$m, and homogenizing the particle size. Thereby, the emulsion fuel oil has excellent burning function.

The emulsion fuel oil, which is sufficiently stirred and finely cut by means of the stirrer A, is fed into the vertical heating bath B comprising an external cylinder B1 and an internal cylinder B2. Water is charged at a space between the cylinders, and a heating unit B3 is positioned at a bottom portion of the external cylinder B1. At one side of a lower inner face of the internal cylinder B2, a certain pipe extended from the outlet pipe A11 of the stirrer A is perforated through the external cylinder B1, to form an inlet B4. At the opposite side thereof, an outlet B5 is formed and extended to a pipeline B5' that is circulated to the stirrer A. Another outlet B6 is formed at one side of a middle inner wall of the internal cylinder B2 and is extended to a pipeline B6' connected to a boiler C. Also, a further outlet B7 is formed at one side of an upper inner wall of the internal cylinder B2 and is extended to a pipeline B7' circulated to the stirrer A. Sensors B8 and B9 sensing oil surface are attached to positions higher than the outlet B7. The member numbers B10 and B11 are assigned to pumps.

When the pump A14 is operated by a control box B12, the emulsion fuel oil flows in the internal cylinder through the inlet B4. When the oil surface reaches the sensor B8, the operation of the pump A14 is stopped and concurrently the pump B10 and the pump B11 are operated, whereby the emulsion fuel oil positioned at the middle layer of the internal cylinder is fed to the boiler C through the outlet B6 and the pump B10. Also, the pump B11 functions to introduce heterogeneous emulsion oil of the upper and the lower layers flowing from the outlet B5 and the outlet B7 into the stirrer A. When oil surface of the vertical heating bath is gradually decreased and reaches the sensor B9, operation of the pump B11 is stopped and the pump A14 is again operated, whereby the emulsion fuel oil is fed to the vertical heating bath B. After oil surface of the stirrer A reaches the sensor A13, the pump A9' is operated and a mixture of the fuel oil additive composition and water is stirred by a first stirrer (not shown) and thusly stirred emulsion fuel oil is introduced into the stirrer A through the pipe A9. When the oil surface reaches the sensor A12, the operation of the pump A9' is stopped.

The emulsion fuel oil filled in the internal cylinder B2 of the vertical heating bath B is not obviously divided to upper, middle and lower-layer oil. In the lower-layer portion, a water-content is relatively high, while an oil-content is relatively high in the upper-layer portion. In the middle layer portion, a content ratio of oil to water is similar to a mixing ratio of a fuel oil additive composition and water. Such division is provided for convenience. Particularly, homogeneous emulsion fuel oil of the middle layer portion, which is excellent in emulsification state, is burned, thereby achieving superior heat efficiency and fuel saving effect.

As for the burning method of the present invention, the fuel oil additive composition having excellent emulsification function is mixed with 40–50 wt % of water, to give the emulsion fuel oil, which is emulsified by use of the stirrer capable of being rapidly rotated at 3600 rpm and uniformly cutting fine particles of 2 $\mu$m. Thusly emulsified fuel oil is fed into the cylindrical vertical heating bath B maintained at 70–80° C., whereby only the middle layer portion of the 3-layer emulsion fuel oil is selectively burned. Meanwhile, the upper and lower layer portions are further circulated to the stirrer A, stirred together with emulsion fuel oil newly fed from the pipe A9, and again circulated to the heating bath B. While the emulsion fuel oil is repeatedly stirred and circulated, it is burned.

In other words, through the present method, the emulsion fuel oil of excellent emulsification state is obtained, which comprises the fuel oil additive composition having excellent emulsification function mixed with water by means of the high functional circulating system. Then, while the emulsification state of such fuel oil is maintained as it is, only a portion having excellent emulsification state is selectively burned, whereby combustion efficiency and fuel saving effect are maximized.

With the aim of confirming the effect of the present invention, 55 wt % of fuel oil additive composition was mixed with 45 wt % of water and burned, by use of the circulating system comprising a stirrer A and a vertical heating bath B. The above experiment was performed for 6 months. As a result, fuel oil savings amounted to 23–25% in terms of fuel cost, exclusive of costs required for preparation of fuel oil additive composition, for preparation of emulsion fuel oil and for operation of stirrer A and vertical heating bath B and burning of the fuel oil.

As described above, according to the method of the present invention, the fuel oil additive composition is mixed with water, to obtain the emulsion fuel oil which is superior in its homogeneity and has very fine particles using the stirrer. In addition, emulsion fuel oil of excellent emulsification state is selectively burned while emulsification state of the fuel oil is maintained at a desired level, thereby achieving excellent combustion efficiency and fuel saving effect.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

I claim:

1. A method of burning emulsion fuel oil, comprising the following steps of:

mixing 40–50 wt % of water with a fuel oil additive composition having excellent emulsification function, to obtain emulsion fuel oil;

stirring the emulsion fuel oil by means of a stirrer capable of uniformly cutting the fuel oil to fine particles of 2 $\mu$m at a fast rotation rate of 3,600 rpm;

feeding the emulsion fuel oil having uniformly cut particles into a cylindrical vertical heating bath, to form a 3-layer emulsion fuel oil;

burning only a middle layer emulsion fuel oil among the 3-layer emulsion fuel oil, followed by again circulating an upper and a lower layer emulsion fuel oil to the stirrer and stirring the circulated fuel oil together with emulsion fuel oil newly provided from an inlet pipe, and feeding the stirred emulsion fuel oil to the vertical heating bath; and repeatedly performing said burning step.

2. The method as set forth in claim 1, wherein said fuel oil additive composition is comprised of:

homogenizing a mixture of 300 parts by weight of coal powders, 50 parts by weight of saturated magnesium chloride solution, 100 parts by weight of soda and 500 parts by weight of sea water, passing homogenized liquid mixture through a catalyst tower packed with uranium ore maintained at 90–95° C. for 10 minutes, heating equal volumes of the liquid mixture and bunker C oil filled in a retort packed with cokes at 95–100° C. until most salt water (85%) is evaporated, to obtain a colloidal liquid remainder, 2–4 vol % of which is added to 96–98 vol % of a mixed oil comprising light oil and bunker C oil at a volume ratio of 1:4 and sufficiently stirred.

* * * * *